US009214727B2

(12) United States Patent
Huang et al.

(10) Patent No.: US 9,214,727 B2
(45) Date of Patent: Dec. 15, 2015

(54) MULTI-BAND ANTENNA

(71) Applicant: AUDEN TECHNO CORP., Taoyuan County (TW)

(72) Inventors: Yu-Tsung Huang, Kaohsiung (TW); Pin-Tang Chiu, Kaohsiung (TW); Yen-Chao Li, Taoyuan County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 80 days.

(21) Appl. No.: 14/276,950

(22) Filed: May 13, 2014

(65) Prior Publication Data

US 2015/0333400 A1 Nov. 19, 2015

(51) Int. Cl.
*H01Q 5/307* (2015.01)
*H01Q 5/20* (2015.01)
*H01Q 5/30* (2015.01)

(52) U.S. Cl.
CPC ..... *H01Q 5/307* (2015.01); *H01Q 5/20* (2015.01); *H01Q 5/30* (2015.01)

(58) Field of Classification Search
CPC ..... H01Q 5/20; H01Q 5/30; H01Q 5/307; H01Q 1/243
USPC ..... 343/700 MS, 702
See application file for complete search history.

(56) References Cited

U.S. PATENT DOCUMENTS 8,072,389 B2 * 12/2011 Chang ..... H01Q 1/38 343/700 MS
2010/0177005 A1 * 7/2010 Hsiao ..... H01Q 1/243 343/845
2010/0289700 A1 * 11/2010 Yang ..... H01Q 9/0421 343/700 MS

* cited by examiner

*Primary Examiner* — Hoang V Nguyen
(74) *Attorney, Agent, or Firm* — Li & Cai Intellectual Property (USA) Office

(57) ABSTRACT

A multi-band antenna comprises a single-pole radiating portion and a coupling radiating portion coupled to a grounding terminal. The single-pole radiating portion has a first radiating unit and a fourth radiating unit coupled to a feeding terminal. The single-pole radiating portion is bent to form a second radiating unit and a third radiating unit. The coupling radiating portion has a fifth radiating unit, and the coupling radiating portion is bent to form a sixth radiating unit. The sixth radiating unit of the coupling radiating portion and the third radiating unit of the single-pole radiating portion are coupled to each other to generate a LTE technology band near 700 MHz. The fifth radiating unit of the coupling radiating portion, the third radiating unit and the fourth radiating unit of the single-pole radiating portion are coupled to each other to generate a high frequency band.

10 Claims, 7 Drawing Sheets

MULTI-BAND ANTENNA

BACKGROUND OF THE INVENTION

1. Field of the Invention

The instant disclosure relates to an antenna; in particular, to a multi-band antenna.

2. Description of Related Art

Please refer to FIG. 1A in conjunction with FIG. 1B, FIG. 1A shows a schematic diagram of a conventional penta-band antenna installed to a mobile communication device, FIG. 1B shows a schematic diagram of a conventional penta-band antenna. A mobile communication device 1 may be a smart phone for example. The mobile communication device 1 comprises casings 11 and 12, a circuit board 13 and a penta-band antenna 14. The circuit board 13 has a grounding plane 131. An antenna location region 132 at a side of the grounding plane 131 is for disposing the penta-band antenna 14. As shown in FIG. 1B, the penta-band antenna 14 may be assembled to a nonconductive substrate 15, in order to improve the convenience of fabrication. The penta-band antenna 14 is a single-pole antenna coupled to a feeding terminal F1. The penta-band antenna 14 has a radiating portion 141 and a radiating portion 142. For the conventional third-generation mobile communication, the penta-band antenna 14 of the mobile communication device 1 needs to provide following five operation bands 850 MHz/900 MHz/1800 MHz/1900 MHz and 2100 MHz. However, due to the development of long germ evolution (LTE) technology, the antenna of the mobile communication device needs to afford more operation bands for fitting in with both requirements of the conventional third-generation mobile communication system and the LTE technology.

SUMMARY OF THE INVENTION

The object of the instant disclosure is to offer a multi-band antenna for providing operation in the frequency range of the long term revolution technology and the conventional third-generation mobile communication system.

In order to achieve the aforementioned objects, according to an embodiment of the instant disclosure, a multi-band antenna is provided. The multi-band antenna comprises a single-pole radiating portion and a coupling radiating portion. The single-pole radiating portion is coupled to a feeding terminal. The single-pole radiating portion has a first radiating unit, a second radiating unit, a third radiating unit and a fourth radiating unit. The first radiating unit and the fourth radiating unit are coupled to the feeding terminal. The single-pole radiating portion is bent through a first bending to form the second radiating unit. The single-pole radiating portion is bent through a second bending to form the third radiating unit. At least a portion of the second radiating unit and at least a portion of the first radiating unit are perpendicular to each other. At least a portion of the first radiating unit and at least a portion of the third radiating unit are parallel to each other. The coupling radiating portion is coupled to a grounding terminal. The coupling radiating portion has a fifth radiating unit and a sixth radiating unit. The fifth radiating unit is coupled to the grounding terminal. The coupling radiating portion is bent through a third bending to form the sixth radiating unit. At least a part of the fifth radiating unit and at least a part of the sixth radiating unit are perpendicular to each other. The sixth radiating unit of the coupling radiating portion and the third radiating unit of the single-pole radiating portion are coupled to each other to generate a LTE technology band near 700 MHz. The fifth radiating unit of the coupling radiating portion, the third radiating unit and the fourth radiating unit of the single-pole radiating portion are coupled to each other to generate a high frequency band.

In summary, the provided multi-band antenna could be installed into a mobile communication device for operating in the frequency range of the long term revolution technology and the conventional third-generation mobile communication system.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1A:
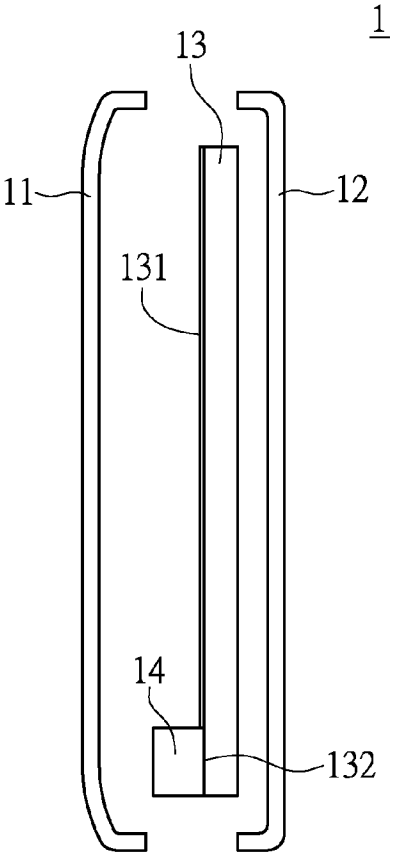
FIG.1A(PRIOR ART)
FIG. 1A shows a schematic diagram of a conventional penta-band antenna installed to a mobile communication device.
Figure 2A:
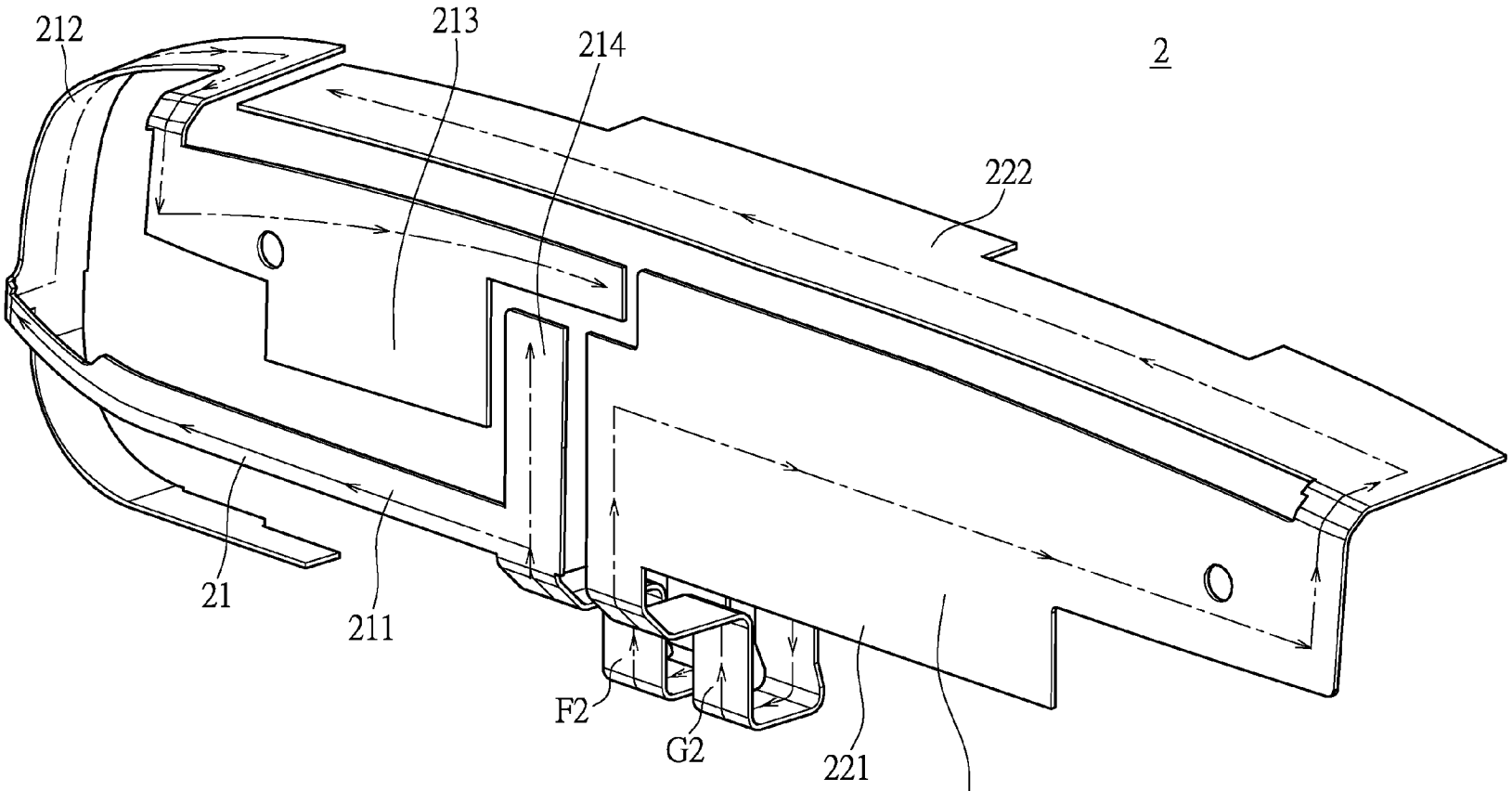
FIG. 2A shows a schematic diagram of a multi-band antenna according to an embodiment of the instant disclosure.
Figure 2B:
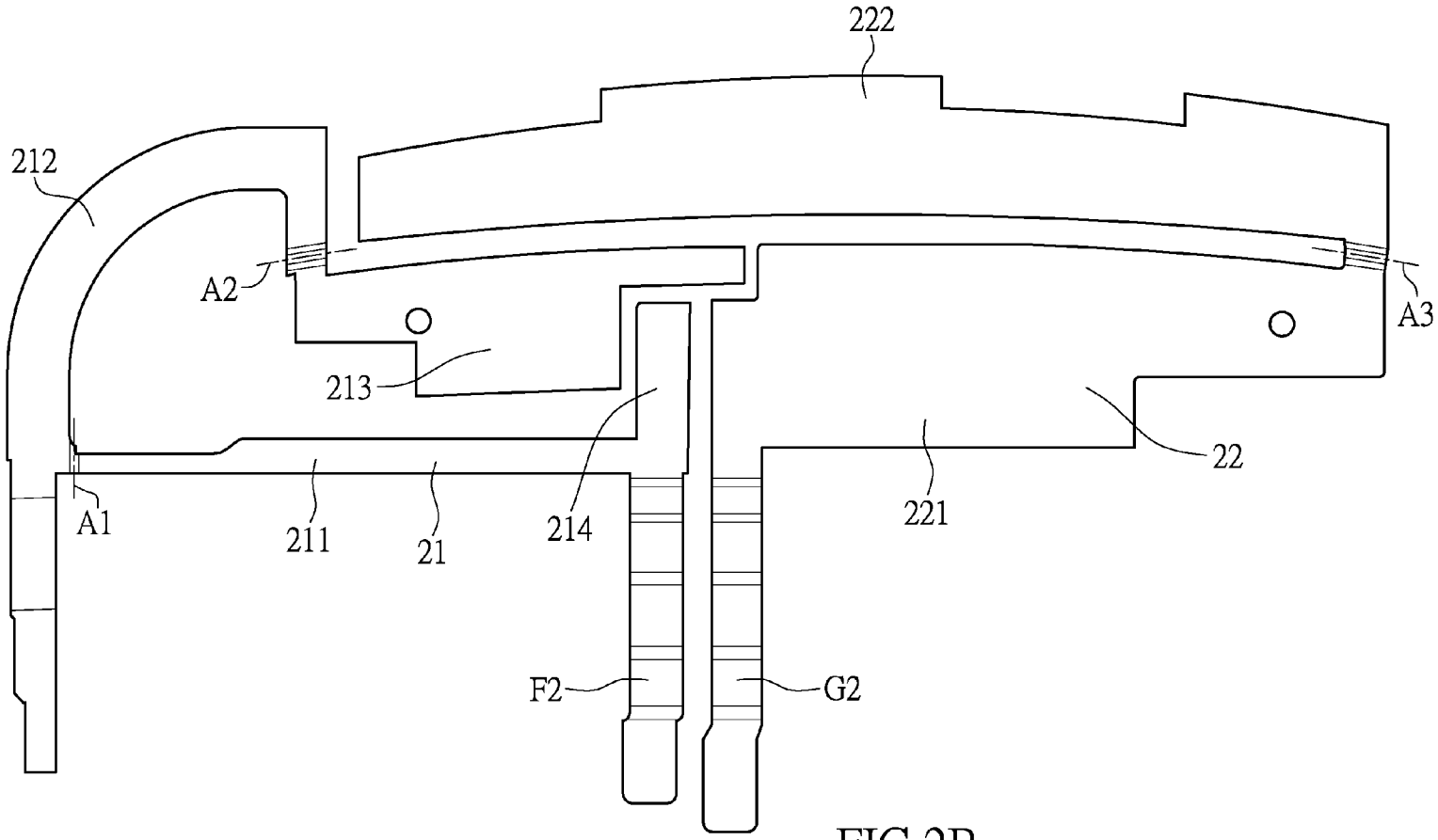
FIG. 2B shows a schematic diagram of an unfolded structure of a multi-band antenna according to an embodiment of the instant disclosure.

Please refer to FIG. 2A in conjunction with FIG. 2B, FIG. 2A shows a schematic diagram of a multi-band antenna according to an embodiment of the instant disclosure, FIG. 2B shows a schematic diagram of an unfolded structure of a multi-band antenna according to an embodiment of the instant disclosure. The multi-band antenna 2 is for installing into a mobile communication device, such as the mobile communication device shown in FIG. 1A.

The multi-band antenna 2 comprises a single-pole radiating portion 21 and a coupling radiating portion 22. The single-pole radiating portion 21 is coupled to a feeding terminal F2. The single-pole radiating portion 21 has a first radiating unit 211, a second radiating unit 212, a third radiating unit 213 and a fourth radiating unit 214. The first radiating unit 211 and the fourth radiating unit 214 are coupled to the feeding terminal F2. The single-pole radiating portion 21 is bent through a first bending (e.g. bending along the bending line A1 shown in FIG. 2B) to form the second radiating unit 212. The single-pole radiating portion 21 is bent through a second bending (e.g. bending along the bending line A2 shown in FIG. 2B) to form the third radiating unit 213. The first radiating unit 211, the second radiating unit 212 and the third radiating unit 213 are for providing a current path. The fourth radiating unit 214 is for providing another current path. It is worth mentioning that, after aforementioned bendings at least a portion of the second radiating unit 212 and at least a portion of the first radiating unit 211 are perpendicular to each other, and at least a portion of the first radiating unit 211 and at least a portion of the third radiating unit 213 are parallel to each other.

The coupling radiating portion 22 is coupled to a grounding terminal G2. The coupling radiating portion 22 has a fifth radiating unit 221 and a sixth radiating unit 222. The fifth radiating unit 221 is coupled to the grounding terminal G2. The coupling radiating portion is bent through a third bending (e.g. bending along the bending line A3 shown in FIG. 2B) to form the sixth radiating unit 222. At least a part of the fifth radiating unit 221 and at least a part of the sixth radiating unit 222 are perpendicular to each other. The fifth radiating unit 221 and the sixth radiating unit 222 are for providing still another current path. The sixth radiating unit 222 of the coupling radiating portion 22 and the third radiating unit 213 of the single-pole radiating portion 21 are coupled to each other to generate a LTE technology band near 700 MHz (usually referred to as the 700 MHz band). In this embodiment, the sixth radiating unit 222 of the coupling radiating portion 22 and the third radiating unit 213 of the single-pole radiating portion 21 are coupled to each other to generate a band covering 704 MHz-960 MHz. Thus, the multi-band antenna 2 could be applied to the conventional mobile communication system operating in GSM850 and GSM900, and the LTE Band 17 (UE (User Equipment) transmit 704-716 MHz, receive 734-746 MHz) and the LTE band 13 (UE transmit 777-787 MHz, receive 746-756 MHz) of the long term evolution technology (referring to the bands defined by the air interface—E-UTRA (Evolved Universal Terrestrial Radio Access) of the LTE technology).

The fifth radiating unit 221 of the coupling radiating portion 22, the third radiating unit 213 and the fourth radiating unit 214 of the single-pole radiating portion 21 are neighbored and coupled to each other to generate a high frequency band. The mentioned high frequency band is a band with frequencies higher than 700 MHz. For example, the high frequency band ranges from 1710 MHz to 2170 MHz. The high frequency band may satisfy following three bands 1800 MHz/1900 MHz/2100 MHz which are utilized in the conventional third-generation mobile communication system. Also, regarding to bands defined by the air interface—E-UTRA, the multi-band antenna could also be applied to the bands of the LTE technology, such as band 10 (UE transmit 1710 MHz-1770 MHz, receive 2110 MHz-2170 MHz), band 9 (UE transmit 1749.9 MHz-1784.9 MHz, receive 1844.9 MHz-1879.9 MHz), band 4 (UE transmit 1710 MHz-1755 MHz, receive 2110 MHz-2155 MHz), band 3 (UE transmit 1710 MHz-1785 MHz, receive 1805 MHz-1880 MHz), band 2 (UE transmit 1850 MHz-1910 MHz, receive 1930 MHz-1990 MHz), band 1 (UE transmit 1920 MHz-1980 MHz, receive 2110 MHz-2170 MHz) . . . etc., but the instant disclosure is not so restricted. Actually, the multi-band antenna 2 of this embodiment could cover all bands of the third-generation mobile communication system and the LTE technology ranging from 1710 MHz to 2500 MHz, and details would be described in FIG. 3.

The multi-band antenna 2 may be formed of a single metal element (e.g. a metal plate or a copper foil) with several bendings. And, the multi-band antenna may be an integrally formed structure, but this instant disclosure is no restricted thereto.

Figure 2C:
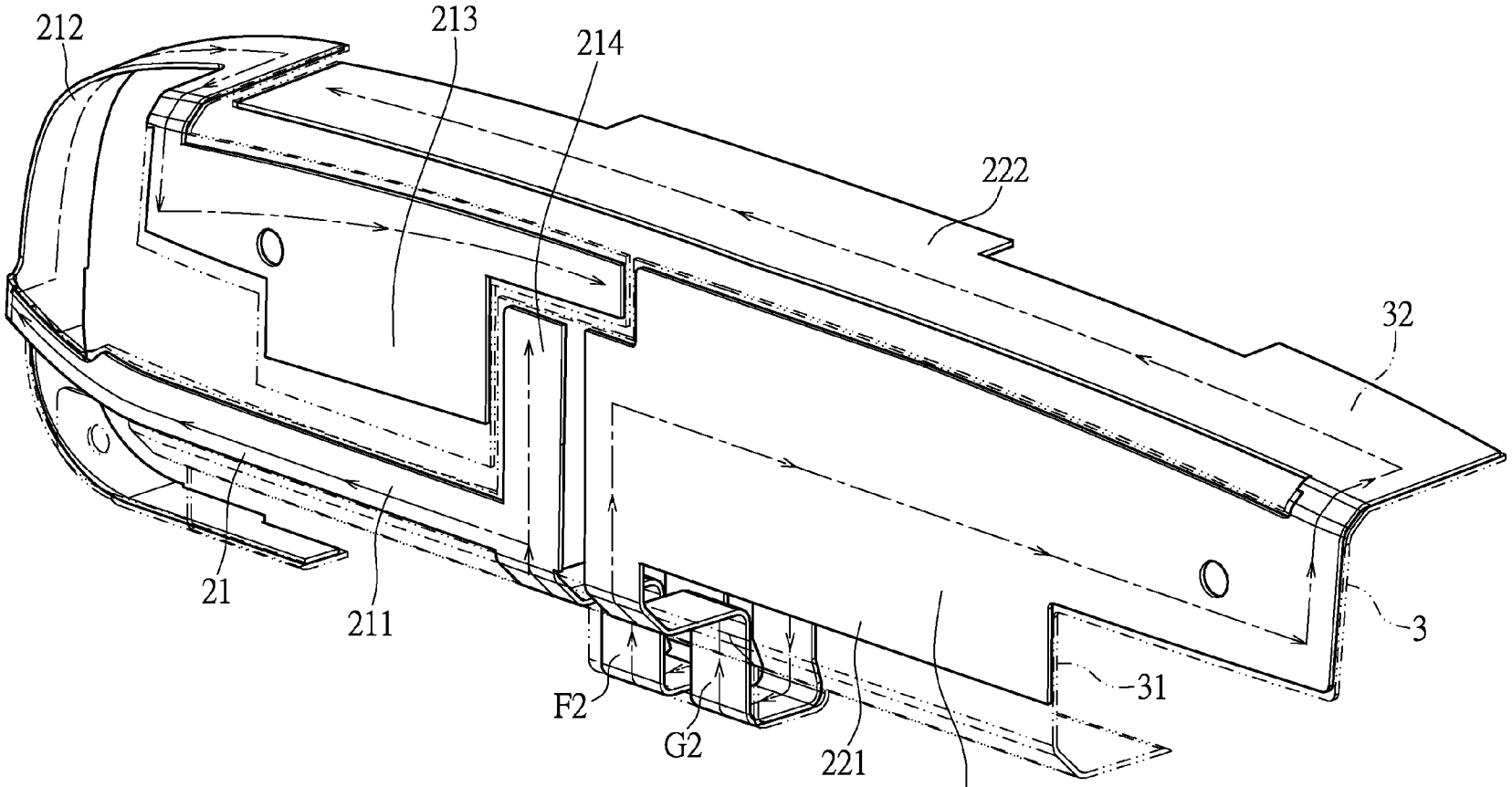
FIG. 2C shows a schematic diagram of a multi-band antenna assembled to a nonconductive substrate according to an embodiment of the instant disclosure.

Please refer to FIG. 2A in conjunction with FIG. 2C, FIG. 2C shows a schematic diagram of a multi-band antenna assembled to a nonconductive substrate according to an embodiment of the instant disclosure. When the multi-band antenna 2 is made, the multi-band antenna 2 may be assembled to a nonconductive substrate 3, thus the single-pole radiating portion 21 and the coupling radiating portion 22 are disposed on the nonconductive substrate 3. The nonconductive substrate 3 may be a plastic substrate, a fiberglass substrate or a ceramic substrate, but the instant disclosure is not so restricted. As shown in FIG. 2A, the shape of the nonconductive substrate 3 is designed according to the shape of the single-pole radiating portion 21 and the coupling radiating portion 22 of the multi-band antenna 2, and the nonconductive substrate 3 is for supporting the multi-band antenna 2, but the instant disclosure is not so restricted. Alternatively, the nonconductive substrate 3 may be a block with a simple shape. Also, the multi-band antenna 2 may bind to the nonconductive substrate 3 through at least a fixture (not shown in the figure), and the mentioned fixture may be a screw, an elastic piece . . . etc., but the kind of the fixture is not so restricted.

In one embodiment, the nonconductive substrate 3 has a first surface 31 and a second surface 32. For example, the first surface 31 and the second surface 32 may be respectively two adjacent surfaces of a block with a simple shape, and the two adjacent surfaces may be substantially perpendicular to each other. The first radiating unit 211, the third radiating unit 213 and the fourth radiating unit 214 of the single-pole radiating portion 21 and the fifth radiating unit 221 of the coupling radiating portion 22 are disposed on the first surface 31 of the nonconductive substrate 3. The second radiating unit 212 of the single-pole radiating portion 21 and the sixth radiating unit 222 of the coupling radiating portion 22 are disposed on the second surface 32 of the nonconductive substrate 3. Although, in this embodiment, the first surface 31 and the second surface 32 are substantially perpendicular to each other, the instant disclosure is not so restricted.

Further, the nonconductive substrate 3 could be assembled to a circuit board. For example, the nonconductive substrate 3 which is assembled with the multi-band antenna 2 could be assembled to the circuit board 13 shown in FIG. 1A, in which the nonconductive substrate 3 could be installed in an antenna location region 132 of the circuit board 13.

Figure 1B:
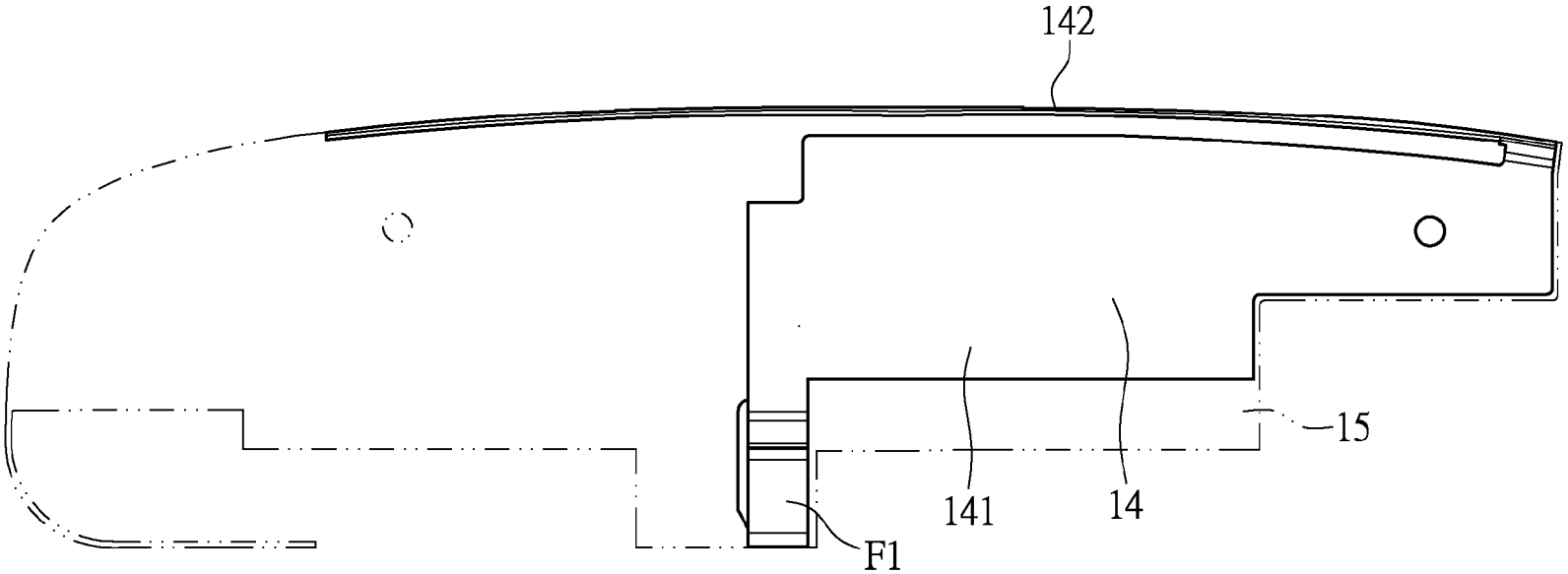
FIG.1B(PRIOR ART)
FIG. 1B shows a schematic diagram of a conventional penta-band antenna.
Figure 3:
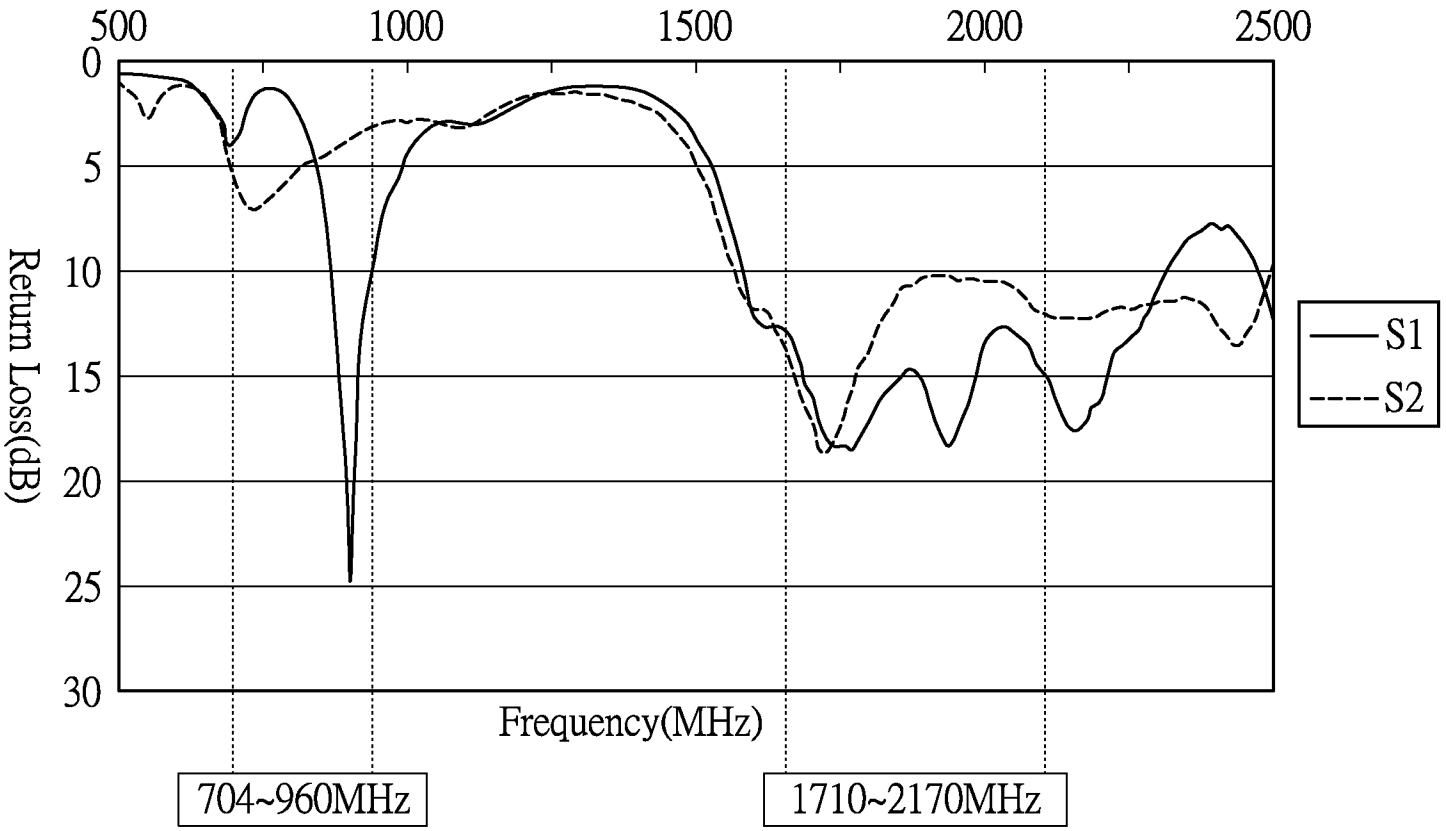
FIG. 3 shows a return loss curve of a multi-band antenna according to an embodiment of the instant disclosure.

Please refer to FIG. 3 showing a return loss curve of a multi-band antenna according to an embodiment of the instant disclosure. The curve S1 is the return loss curve of the conventional penta-band antenna shown in FIG. 1B. The curve S2 is the return loss curve of the multi-band antenna 2 of an embodiment of the instant disclosure. Regarding to the lower-frequency band, it is obvious that the return loss curve S1 does not provide enough frequency coverage for the band of 704 MHz-960 MHz. However, the return loss curve S2 of the multi-band antenna 2 could provide a good impedance match in the whole band of 704 MHz-960 MHz. Further, regarding to the higher-frequency band, according to the return loss curves S1 and S2, the multi-band antenna 2 of this embodiment and the conventional penta-band antenna both provide good impedance match for the frequencies ranging from 1710 MHz-2170 MHz. Furthermore, the impedance bandwidth of the multi-band antenna 2 covers 1710 MHz-2500 MHz for 9.5 dB return loss or 2:1 VSWR.

Figure 4:
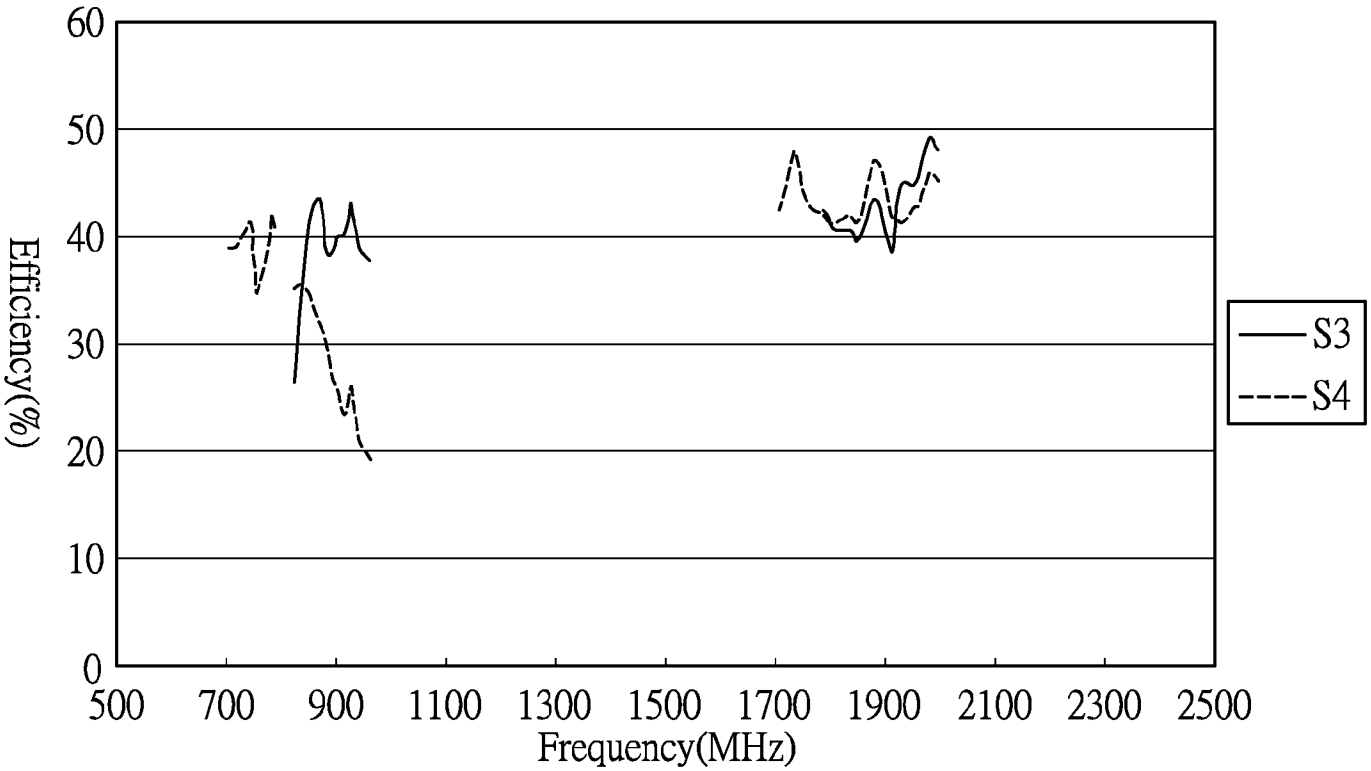
FIG. 4 shows an efficiency curve of a multi-band antenna according to an embodiment of the instant disclosure.

Please refer to FIG. 4 showing an efficiency curve of a multi-band antenna according to an embodiment of the instant disclosure. The efficiency of the conventional penta-band antenna is shown by the curve S3, in which the efficiency is about 39% for the lower-frequency band, and the efficiency is about 44% for the higher-frequency band. Relatively, the efficiency of the multi-band antenna 2 is shown by the curve S4, in which the efficiency is about 34% for the lower-frequency band, and the efficiency is about 43% for the higher-frequency band. As mentioned above, the multi-band antenna 2 of this embodiment could provide good antenna efficiency.

According to above descriptions, a multi-band antenna is provided in the embodiment, in which the single-pole radiating portion and the coupling radiating portion of the multi-band antenna are coupled to each other in order to increase the bandwidth of the antenna. The multi-band antenna could be an integrally formed structure, and the structure of the multi-band antenna is simple and easily manufactured, in which it only needs several bending processes to accomplish the structure of the multi-band antenna. The provided multi-band antenna could be installed into a mobile communication device for operating in the frequency range of the long term revolution technology and the conventional third-generation mobile communication system.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A multi-band antenna, comprising:

a single-pole radiating portion, coupled to a feeding terminal, the single-pole radiating portion having a first radiating unit, a second radiating unit, a third radiating unit and a fourth radiating unit, the first radiating unit and the fourth radiating unit coupled to the feeding terminal, the single-pole radiating portion being bent through a first bending to form the second radiating unit, the single-pole radiating portion being bent through a second bending to form the third radiating unit, at least a portion of the second radiating unit and at least a portion of the first radiating unit being perpendicular to each other, at least a portion of the first radiating unit and at least a portion of the third radiating unit being parallel to each other; and a coupling radiating portion, coupled to a grounding terminal, the coupling radiating portion having a fifth radiating unit and a sixth radiating unit, the fifth radiating unit coupled to the grounding terminal, the coupling radiating portion being bent through a third bending to form the sixth radiating unit, at least a part of the fifth radiating unit and at least a part of the sixth radiating unit being perpendicular to each other, wherein the sixth radiating unit of the coupling radiating portion and the third radiating unit of the single-pole radiating portion are coupled to each other to generate a LTE technology band near 700 MHz, the fifth radiating unit of the coupling radiating portion, the third radiating unit and the fourth radiating unit of the single-pole radiating portion are coupled to each other to generate a high frequency band.

2. The multi-band antenna according to claim 1, further comprising:

a nonconductive substrate, the single-pole radiating portion and the coupling radiating portion disposed on the nonconductive substrate.

3. The multi-band antenna according to claim 2, wherein the nonconductive substrate is assembled to a circuit board, the nonconductive substrate is installed in an antenna location region of the circuit board.

4. The multi-band antenna according to claim 2, wherein the nonconductive substrate having a first surface and a second surface, the first radiating unit, the third radiating unit and the fourth radiating unit of the single-pole radiating portion and the fifth radiating unit of the coupling radiating portion are disposed on the first surface of the nonconductive substrate, the second radiating unit of the single-pole radiating portion and the sixth radiating unit of the coupling radiating portion are disposed on the second surface of the nonconductive substrate.

5. The multi-band antenna according to claim 2, wherein the nonconductive substrate is a plastic substrate, a fiberglass substrate or a ceramic substrate.

6. The multi-band antenna according to claim 2, wherein the multi-band antenna is binding to the nonconductive substrate through at least a fixture.

7. The multi-band antenna according to claim 1, wherein the multi-band antenna is an integrally formed structure.

8. The multi-band antenna according to claim 1, wherein the multi-band antenna is formed of a single metal element with several bendings.

9. The multi-band antenna according to claim 1, wherein the high frequency band ranges from 1710 MHz to 2170 MHz.

10. The multi-band antenna according to claim 1, wherein the sixth radiating unit of the coupling radiating portion and the third radiating unit of the single-pole radiating portion are coupled to each other to generate a band covering 704 MHz-960 MHz.

* * * * *